US007484836B2

(12) United States Patent
Moynihan

(10) Patent No.: US 7,484,836 B2
(45) Date of Patent: Feb. 3, 2009

(54) SYSTEM AND METHODS FOR FLUID DROP EJECTION

(75) Inventor: Edward R. Moynihan, Plainfield, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 120 days.

(21) Appl. No.: 10/946,355

(22) Filed: Sep. 20, 2004

(65) Prior Publication Data

US 2006/0061636 A1 Mar. 23, 2006

(51) Int. Cl.
*B41J 2/17* (2006.01)
*B41J 2/14* (2006.01)

(52) U.S. Cl. ..... 347/84; 347/47

(58) Field of Classification Search ..... 347/40, 347/43, 47, 70, 71, 84; 239/102.2; 29/890.1
See application file for complete search history.

(56) References Cited

U.S. PATENT DOCUMENTS

| | | | | | |
|---|---|---|---|---|---|
| 4,131,899 | A * | 12/1978 | Christou | 347/71 |
| 4,901,093 | A * | 2/1990 | Ruggiero et al. | 347/70 |
| 5,640,184 | A * | 6/1997 | Moynihan et al. | 347/47 |
| 5,757,391 | A | 5/1998 | Hoisington | |
| 5,757,400 | A | 5/1998 | Hoisington | |
| 5,889,538 | A * | 3/1999 | Kishimoto et al. | 347/43 |
| 6,083,411 | A * | 7/2000 | Nakayama et al. | 216/27 |
| 6,084,609 | A * | 7/2000 | Manini et al. | 347/40 |
| 6,089,698 | A * | 7/2000 | Temple et al. | 347/47 |
| 6,099,108 | A * | 8/2000 | Weber et al. | 347/43 |
| 6,312,120 | B1 * | 11/2001 | Ando et al. | 347/95 |
| 6,474,786 | B2 | 11/2002 | Percin et al. | |
| 6,592,203 | B1 | 7/2003 | Bates et al. | |
| 6,779,861 | B2 * | 8/2004 | Mori | 347/12 |
| 7,040,016 | B2 * | 5/2006 | Bergstrom et al. | 29/890.1 |
| 2002/0175220 | A1 * | 11/2002 | Pence | 239/102.2 |
| 2003/0201246 | A1 * | 10/2003 | Hardisty et al. | 216/27 |
| 2005/0146561 | A1 * | 7/2005 | Bibl et al. | 347/47 |
| 2007/0273726 | A1 | 11/2007 | Rosenblum et al. | |

FOREIGN PATENT DOCUMENTS

| | | | |
|---|---|---|---|
| JP | 07 032596 | A | 2/1995 |
| JP | 10 315463 | A | 12/1998 |
| JP | 2002 154 199 | A | 5/2002 |
| JP | 2002 248 774 | A | 9/2002 |

OTHER PUBLICATIONS

International Search Report and Written Opinion of the International Searching Authority, International Application Serial No. PCT/US2005/033858, Feb. 6, 2006, 13 pp.
International Search Report and Written Opinion of the International Searching Authority, International Application Serial No. PCT/US2007/069688, Feb. 29, 2008, 8 pp.

* cited by examiner

*Primary Examiner*—Stephen D Meier
*Assistant Examiner*—Carlos A Martinez, Jr.
(74) *Attorney, Agent, or Firm*—Fish & Richardson P.C.

(57) ABSTRACT

A drop ejection device includes a group of orifices adapted to eject fluid drops. The fluids ejected from the orifices merge into a fluid drop. The orifices are separated by walls which define the orifices. The merging of the fluid into a fluid drop depends on the spacing of the orifices and the waveform applied to actuators which cause the fluid to be ejected.

48 Claims, 7 Drawing Sheets

SYSTEM AND METHODS FOR FLUID DROP EJECTION

TECHNICAL FIELD

This application relates to the field of fluid drop ejection.

BACKGROUND

Ink jet printers typically include an ink path from an ink supply to a nozzle path. The nozzle path terminates in a nozzle opening from which ink drops are ejected. Ink drop ejection is controlled by pressurizing ink in the ink path with an actuator, which may be, for example, a piezoelectric deflector, a thermal bubble jet generator, or an electro statically deflected element. A typical printhead has an array of ink paths with corresponding nozzle openings and associated actuators, and drop ejection from each nozzle opening can be independently controlled. In a drop-on-demand printhead, each actuator is fired to selectively eject a drop at a specific pixel location of an image as the print head and a printing substrate are moved relative to one another. The ink in the ink conduit of an ink jet printing system is usually kept at a negative pressure to keep the ink from spilling over the nozzle plate. In addition, the ink nozzles are required to be primed by the ink fluid for proper ink drop ejection.

SUMMARY

In one aspect, a drop ejection device has a group of orifices adapted to eject fluid drops, a fluid conduit fluidly coupled to the group of orifices, an actuator to eject fluid contained in the fluid conduit through at least two of the orifices, and a controller coupled to the actuator. The orifices and controller are configured such that the fluids ejected from the orifices merge into a fluid drop.

In another aspect, a drop ejection device has a plurality groups of orifices adapted to eject fluid drops, a fluid conduit fluidly coupled to each group of orifices, and an actuator associated with each group of orifices. The actuator is capable of ejecting fluid from the fluid conduit through the orifices. The orifices are closer to other orifices in the same group than to the orifices from a different group and the orifices within a group are disposed in a substantially non-linear pattern.

In yet another aspect, an ink jet print head has a group of orifices adapted to eject ink drops, a fluid conduit fluidly coupled to the group of orifices, an actuator capable of ejecting an ink fluid in the fluid conduit through at least two of the orifices, and a controller coupled to the actuator. The orifices and controller are configured such that the ink fluids ejected from the orifices merge into an ink drop.

In still another aspect, an ink jet print head has a plurality groups of orifices adapted to eject ink drops, a fluid conduit fluidly coupled to each group of orifices, and an actuator associated with each group of orifices. The actuator is capable of ejecting an ink fluid from the fluid conduit through the orifices. The orifices are closer to other orifices in the same group than to the orifices from a different group and the orifices within a group are disposed in a substantially non-linear pattern.

In another aspect, a method for ejecting fluid includes providing a fluid conduit fluidly coupled to a group of orifices, ejecting a fluid from the in the conduit fluidly through at least two orifices in the group, and merging the ejected fluid into a fluid drop.

In another aspect, a method for ejecting fluid includes providing a plurality groups of orifices adapted to eject fluid drops, disposing the orifices within a group in a substantially non-linear pattern, and coupling a fluid conduit to each group of orifices. The orifices are closer to other orifices in the same group than to the orifices from a different group.

Implementations may include one or more of the following. A drop ejection device can have a group of orifices adapted to eject fluid drops, a fluid conduit fluidly coupled to the group of orifices, an actuator to eject fluid contained in the fluid conduit through at least two of the orifices, and a controller coupled to the actuator, wherein the orifices and controller are configured such that the fluids ejected from the orifices merge into a fluid drop. The drop ejection device can include at least two orifices having substantially the same dimensions or different dimensions. The group of orifices can include a first orifice and a plurality of second orifices, wherein the first orifice is surrounded by the plurality of second orifices. The opening of the first orifice can be wider than the openings of the second orifices. The fluid ejected from all the orifices in the group of orifices can be merged into a single fluid drop. The nozzle plate portions separating the orifices can be substantially equal or smaller than the widths of the fluid ejected from the orifices. The drop ejection device can comprise a fluid ejection actuator that can actuate the fluid ejection through the orifices. The fluid ejection actuator can include a piezoelectric transducer or a heater. An electronic control unit can provide control to the fluid ejection actuator. The electronic control unit can control the fluid ejection actuator to eject fluid drops to form an image on a substrate.

The drop ejection device can further include an electronic selector that can actuate the ejection of fluid. The fluid drop can vary in volume in response to different drive voltage waveforms applied to the fluid ejection actuator by the electronic control unit. The fluid drop can form a substantially single fluid dot on a fluid-receiving substrate. Separate meniscuses can be formed at different orifices in the group of orifices. The orifices can be in the shape of a circle, a hexagon, a triangle, or a polygon. The group of orifices can formed in a substantially circular area on the nozzle plate. The controller can be configured to select one of a plurality of different drive voltage waveforms. A first of the plurality of different drive voltage waveforms can cause fluid not to be ejected from at least one of the orifices, and a second of the plurality of different drive voltage waveforms can cause fluid to be ejected from the at least one of the orifices.

The orifices can have opening dimensions in the range from 1 μm to 100 μm, or in the range from 3 μm to 50 μm. The orifices can have bubble pressure over 6 inch wg or over 8 inch wg. The drop ejection device can further comprise a silicon substrate. The orifices can be fabricated using one or more of etching, laser ablation, and electroforming. The fluid can include at least one colorant that optionally comprises a dye or pigment.

Implementations can also include one or more of the following. A drop ejection device can include a plurality groups of orifices adapted to eject fluid drops, a fluid conduit fluidly coupled to each group of orifices, and an actuator associated with each group of orifices, the actuator being capable of ejecting fluid from the fluid conduit through the orifices. The orifices are closer to other orifices in the same group than to the orifices from a different group and the orifices within a group are disposed in a substantially non-linear pattern. The fluids ejected from two or more of orifices in a group of orifices can merge into a fluid drop. The orifices within a group of orifices can have substantially the same dimensions. The orifices within a group of orifices can have the different dimensions. The orifices within a group include a first orifice and a plurality of second orifices surrounding the first orifice.

The fluid ejection actuator can include a piezoelectric transducer or a heater. The drop ejection device can further comprise an electronic control unit controls the fluid ejection actuator to eject fluid drops and to form an image on a substrate. The drop ejection device can further comprise an electronic selector that can select the fluid ejection actuator to actuate the ejection of the fluid drop. The fluid drop can vary in volume in response to different drive voltage waveforms applied to the fluid ejection actuator by the electronic control unit. Separate meniscuses can be formed at different orifices in each group of orifices. Each group of orifices can be formed in a substantially compact area on the nozzle plate. At least one group of orifices can be formed in a substantially circular area on the nozzle plate. The orifices can be in the shapes of one or more of a circle, a hexagon, a triangle, or a polygon. The orifices can have opening dimensions in the range from 1 μm to 100 μm, e.g., opening dimensions in the range from 3 μm to 50 μm. The orifices can have bubble pressures over 6 inch wg, e.g., bubble pressures over 8 inch wg. The drop ejection device can further comprise a silicon substrate. The orifices can be fabricated using one or more of etching, laser ablation, and electroforming. The fluid can comprises at least one colorant.

Embodiments may include one or more of the following advantages. The ink jet printing system disclosed provides reliable performance under a wide range of operating conditions. The disclosed system is capable of ejecting large ink drops. The ink nozzles are properly primed while the ink fluid is kept from spilling over the nozzle plate. The ink jet print head can provide consistent ink ejection direction and thus precise ink dot placement on ink receiver. The ink jet printing system disclosed is capable of providing the above performance at high acceleration of printheads.

Another advantage of the disclosed ink jet printhead is that it provides robust performance in the presence of mechanical vibrations in the environment or when the printhead is subject to significant accelerations. Ink meniscuses can be held in position within the ink orifices even when the printhead is perturbed by environmental forces.

Yet another advantage is that the disclosed ink jet printhead can be fabricated using silicon-based fabrication technologies. The disclosed system and methods are also compatible with piezoelectric, thermal and MEMS-based ink jet printing systems. The disclosed system and methods are also applicable to water-based inks, solvent-based inks, hot-melt inks, which can include colorants such as dye or pigment, as well as other fluids without containing colorants.

The details of one or more embodiments are set forth in the accompanying drawings and in the description below. Other features, objects, and advantages of the invention will become apparent from the description and drawings, and from the claims.

DETAILED DESCRIPTION

Figure 1:
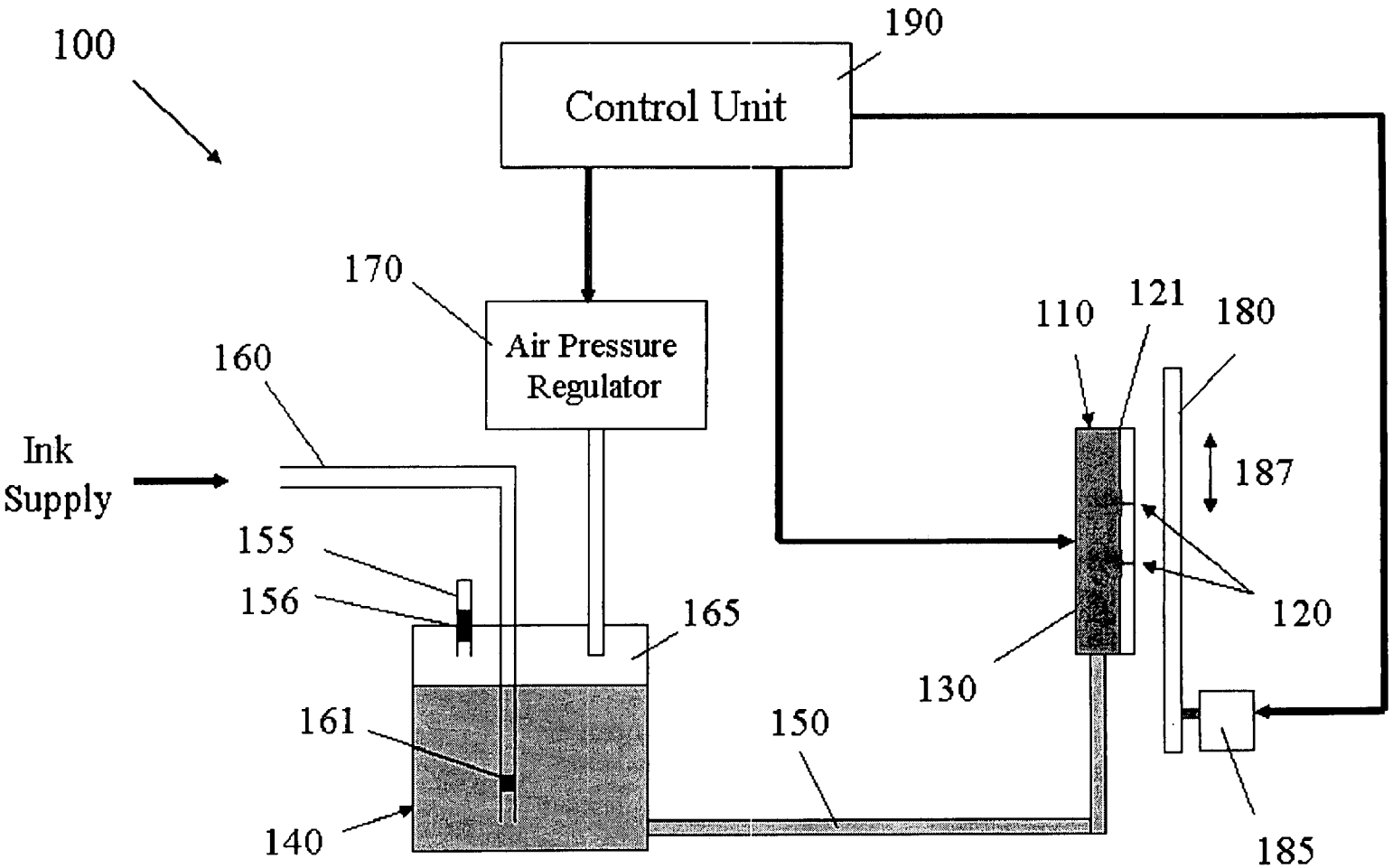
FIG. 1 is a block diagram of ink jet printing system having ink nozzles.

FIG. 1 illustrates an ink jet printing system 100 that includes an ink jet print head module 110 having a plurality of ink nozzles 120 typically arranged in arrays on a nozzle plate 121, a fluid conduit 130 for supplying ink to the ink jet print head module 110, an ink reservoir 140 for storing the ink to be supplied to the fluid conduit 130, and an ink passage 150 that provides fluid connection between the ink reservoir 140 and the fluid conduit 130. During printing, ink drops are ejected from the ink nozzles 120 under the control of an electronic control unit 190 in response to input image data to form an image pattern of ink dots on an ink receiver 180. The ink jet printing system 100 can include a plurality of ink nozzles 120, each nozzle associated with one or more ink ejection actuators. The ink ejection actuators can include a piezoelectric transducer, a heater, or an MEMS transducer device. The ink jet printing system 100 can further comprise an electronic selector that can select the ink ejection actuators associated with the ink nozzle 120 from which the fluid drop will be ejected.

Figure 2A:
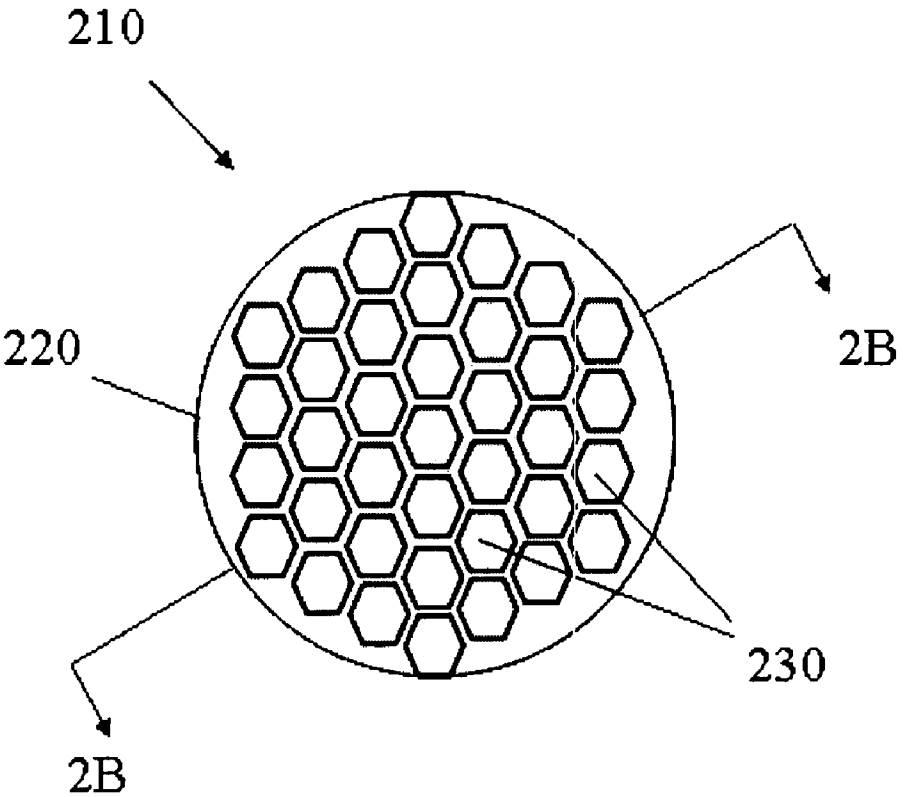
FIG. 2A is a top view of one implementation of an ink nozzle.
Figure 2B:
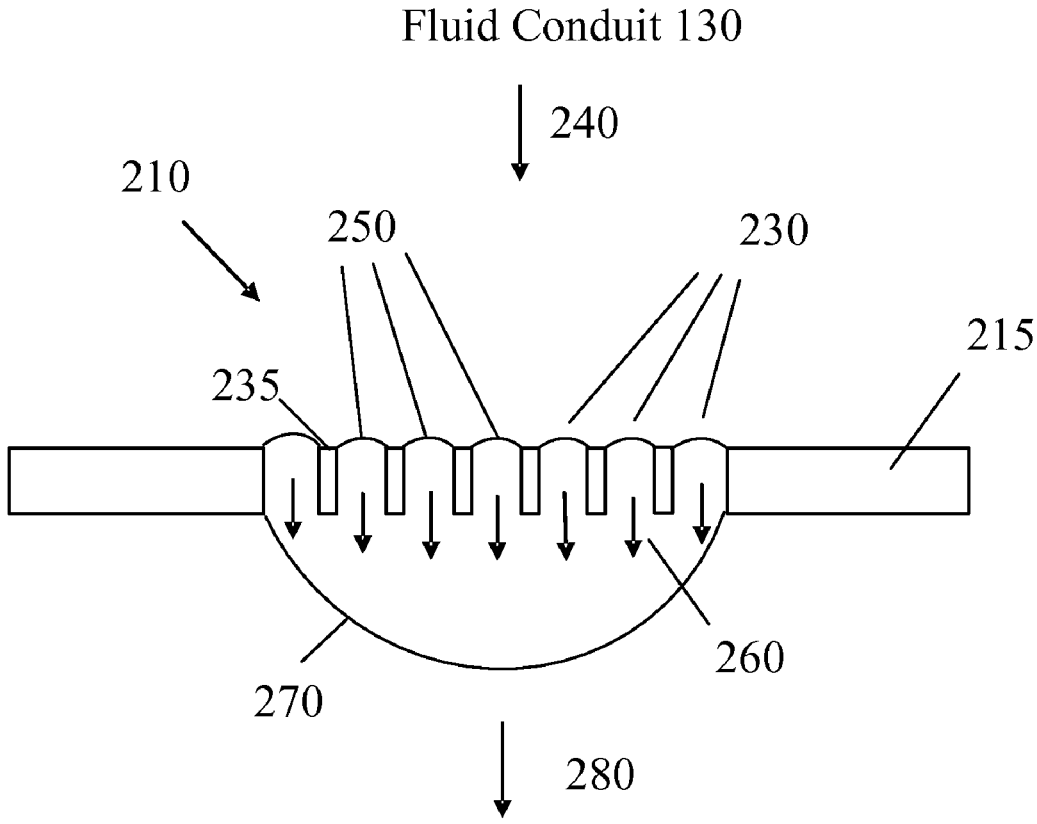
FIG. 2B illustrates a cross-sectional view of the ink nozzle of FIG. 2A.

As shown in FIGS. 1, 2A and 2B, each ink nozzle 120 comprises a plurality of closely distributed orifices 230. Ink nozzles 120 are separated by distances significantly larger than those between neighboring orifices 230 within each ink nozzle. The ink fluid contained in the fluid conduit 130 is ejected from the orifices corresponding to each ink nozzle 120 under the control of the control unit 190. The ink fluid ejected from the orifices can merge into an ink drop after the ejection. The ejected ink drop can vary in volume in response to different drive voltage waveforms applied to the ink ejection actuator by the electronic control unit 190.

The ink jet print head module 110 can exist in the form of piezoelectric ink jet, thermal ink jet, MEMS based ink jet print heads, and other types of ink actuation mechanisms. For example, Hoisington et al. U.S. Pat. No. 5,265,315, the entire content of which is hereby incorporated by reference describes a print head that has a semiconductor print head body and a piezoelectric actuator. The print head body is made of silicon, which is etched to define a fluid conduit. Nozzle openings are defined by a separate nozzle plate 121, which is attached to the silicon body. The piezoelectric actuator has a layer of piezoelectric material, which changes geometry, or bends, in response to an applied voltage. The bending of the piezoelectric layer pressurizes ink in a fluid conduit that supplies the ink to the ink orifices.

Other ink jet print heads are disclosed in commonly assigned U.S. patent application Ser. No. 10/189,947, US Patent Publication No. US20040004649A1, titled "Printhead", filed on Jul. 3, 2002, and US Patent Publication No. 20050099467A1, titled "Print head with thin membrane", filed Oct. 8, 2004. The content of these related patent applications and publications are herein incorporated by reference. US Patent Publication No. 20050099467A1 discloses a printhead having a monolithic semiconductor body with an upper face and a lower face. The body defines a fluid path including a fluid conduit, and a nozzle opening. The nozzle opening is defined in the lower face of the body and the nozzle flow path includes an accelerator region. A piezoelectric actuator is associated with the fluid conduit. The actuator includes a piezoelectric layer having a thickness of about 50 micron or less.

The ink reservoir 140 includes an ink-feeding path 160 having an ink filter 161 that supplies ink to the ink reservoir 140. The ink reservoir 140 also has an air inlet 155 having an air filter 156 that allows the ink level to vary in the ink reservoir 140.

Ink types compatible with the described ink jet printing system include water-based inks, solvent-based inks, and hot melt inks. The ink fluids may include colorants such as a dye or a pigment. The fluids also may not include any colorant. Other fluids compatible with the system may include polymer solutions, gel solutions, solutions containing particles or low molecular-weight molecules.

The hydrostatic pressure in fluid conduit 130, the ink reservoir 140, and ink passage 150 needs to be controlled for proper ink jet printing and head maintenance operations. Insufficient hydrostatic pressure at the ink jet nozzles 120 can cause the ink meniscus at the nozzles to retract within the ink jet nozzles 120. On the other hand, excessive hydrostatic pressure at the ink jet nozzles 120 can cause the ink to leak from the ink jet nozzles 120, producing ink spilling on the nozzle plate 121.

The pressure of air in the space 165 over the fluid in the ink reservoir 140 is typically controlled to keep the pressure at the nozzles slightly below atmospheric pressure (e.g. at −1 inch to −4 inches of water). The air pressure in the space 165 is regulated by an air pressure regulator 170 that can pump air from the space 165 under the control of the control unit 190.

The ink jet printing system 100 can also include a mechanism 185 that transports an ink receiver 180 along a direction 187. In one embodiment, the ink jet print head module 110 can move in reciprocating motion driven by a motor via an endless belt. The direction of the motion is often referred to as the fast scan direction. A second mechanism can transport the ink receiver 180 along a second direction (commonly referred as the slow scan direction) that is perpendicular to the first direction. During the ink jet printing operations, the ink jet print head module 110 disposes ink drops to form a swath of ink dots on the ink receiver 180. In another embodiment, a page-wide ink jet print head module 110 is formed by a print head bar or an assembly of print head modules. The ink jet print head module 110 remains still during printing while the ink receiving media is transported along the slow scan direction under the ink jet print head module 110. The ink jet system and methods are compatible with different print head arrangements known in the art. For example, the system and methods are applicable to a single pass ink jet printer with offset ink jet modules disclosed in the commonly assigned U.S. Pat. No. 5,771,052, the content of which is incorporated by reference herein.

As described previously, the ink pressure in the ink conduit of an ink jet printing system is kept negative to keep the ink from spilling on the nozzle plate, especially during the high-acceleration movement of the ink jet print head. In addition, the ink nozzles are required to be primed by the ink fluid for proper ink drop ejection. Under certain system configurations and certain operating conditions, an operating pressure cannot be found at which the ink can be kept from spilling on the nozzle plate while keeping ink nozzles primed. Such a situation can occur when a print head needs to produce a large ink drop volume and to experience high-acceleration movement. The nozzle diameter needs to be large for the ejection of large ink drops. A large negative pressure is needed to keep the ink from spilling on the nozzle plate during acceleration or deceleration. But the nozzle opening prevents the ink from being primed the nozzles.

In one embodiment, the ink jet printing system 100 overcomes the above described problem by providing a large ink drop volume as well as the proper priming of the ink nozzles. An ink's ability to prime an opening such as an ink nozzle is determined by a property called bubble pressure. The bubble pressure is a function of the nozzle diameter (or opening dimensions) and the surface tension of the ink. As shown in Table I, the bubble pressure decreases as the nozzle diameter increases. When the magnitude of the negative pressure in the ink fluid is higher than the bubble pressure of a nozzle, the ink will pulled back from the nozzle. Air bubbles will be ingested into the ink body in fluid conduit 130. The nozzle is not properly primed. In other words, the magnitude of the negative ink pressure has to be smaller than the bubble pressure.

TABLE I

Fluid Bubble Pressure * as a Function of the Orifice Diameter

| Orifice Diameter (microns) | Meniscus Pressure (inch wg) |
|---|---|
| 30 | 16.1 |
| 40 | 12.0 |
| 50 | 9.6 |
| 60 | 8.0 |
| 70 | 6.9 |
| 80 | 6.0 |
| 90 | 5.4 |
| 100 | 4.8 |
| 110 | 4.4 |
| 120 | 4.0 |
| 130 | 3.7 |
| 140 | 3.4 |

* At ink surface tension of 30 dynes/cm.

In one aspect, the ink jet print head module 110 in ink jet printing system 100 provides ink nozzles having high bubble pressure while still being able to deliver large ink drop volume. In another aspect, the increase of drop volume and the decrease of the nozzle bubble pressure are decoupled.

In one embodiment, FIG. 2A illustrates a top view of an ink nozzle 210 on the nozzle plate 121 compatible with the ink jet print head module 110. The ink nozzle 210 defines a nozzle region 220 comprising a group of orifices 230. In one implementation, the orifices 230 are disposed in a compact formation within a substantially circular area defined by the nozzle region 220. In one implementation, the orifices 230 in the group are in hexagon shape having substantially the same dimensions. Alternatively, the group of orifices may be of other shapes such as triangles, squares, or circles. The orifices in each group can be in the same or different dimensions. The nozzle region 220 typically spans in a range of 1 μm to 300 μm. The orifice opening dimensions are typical in the range from 1 μm to 100 μm, preferably in the range of 3 μm to 50 μm.

FIG. 2B illustrates a cross-sectional view of the ink nozzle 210 of FIG. 2A along the line of 2B-2B. The ink nozzle 210 is formed in a nozzle plate 215. The cross section of the ink nozzle 210 includes a group of orifices 230 separated by separation walls 235. The ink fluid is supplied from the fluid conduit 130 along the direction 240. Separate meniscuses 250 are formed in the orifices 230. In non-ejection states, the meniscuses 250 form concave shapes curving toward the direction of the fluid conduit 130 due to the negative pressure applied to the ink body. The negative ink pressure holds the ink meniscuses 250 at the inner ends of the ink orifices 230 and prevents the ink from spilling over the nozzle plate 215. Before ink ejection, an outward pressure wave is generated in the ink fluid by the ink actuator under the control of the control unit 190. The ink fluid is pushed outward along direction 260. The ejected ink fluid from separate orifices 230 merge to form a common ink surface 270 moving along an outward direction 280. An ink drop is then broken off which may finally land on an ink receiver 180. Thus, in this implementation, the ejected ink merges as it emerges from the different orifices 230.

In one implementation, the ink ejected from different orifices 230 can form separate ink drops in flight and merge together as an ink dot on the ink receiver 180. The location where ink mergers can depend on a number of factors such as the volume of the ink drops, the spacing between the orifices 230, and the waveform applied to the actuators by the control unit 190. As discussed below in relation to FIG. 4, the ink fluids ejected from orifices belonging to different nozzles cannot be merged before they arrive at the ink receiver 180 because a significantly longer distance between the orifices in neighboring nozzles.

In another implementation, the ink ejected from different orifices 230 can first form separate ink drops before merging into one or more ink drops in flight. The widths of the separation walls 235 are substantially equal or smaller than the widths of the fluid ejected from the orifices 230 such that the fluid ejected from the orifices 230 can be merged into a fluid drop. The merging of ink fluids can occur right after the ink fluids emerged from the orifices or "in flight" after individual ink drops have been formed in the air.

The orifices 230, the nozzle plate 215 and the fluid conduit 130 can be formed in a silicon substrate. The orifices are fabricated using one or more of etching, laser ablation, and electroforming. For example, fabrication techniques disclosed in commonly assigned U.S. Pat. No. 5,265,315, U.S. patent application Ser. No. 10/189,947, U.S. Patent Publication No. U.S. 20040004649A1, titled "Printhead", filed on Jul. 3, 2002, and U.S. Provisional Patent Application No. 60/510,459, titled "Print head with thin membrane", filed Oct. 10, 2003. The content of these patent applications and publications are herein incorporated by reference.

The bubble pressures in the ink nozzle 210 are determined by the ink surface tension and the dimensions of the orifices 230. The volume of the merged ink drop is determined by all the ink ejected collectively from several or all the orifices 230 in the nozzle region 220. In comparison, a large single-opening nozzle is required if the same ink drop is ejected from one nozzle having one opening. The bubble pressures of the orifices 230 can thus be significantly higher than the bubble pressure of the single-opening nozzle. The bubble pressures of the orifices 230 can be designed to be above a predetermined ink pressure. For example, as shown in Table 1, orifices at diameters of 50 μm or smaller can result in bubble pressures above 8 inch wg at a surface tension of 30 dyne/cm, no matter how large an ink drop is ejected. The volume of the merged ink drop can be flexibly increased by scaling up the number of the orifices 230. For a fixed group of orifices 230, the merged ink drop volume can also be varied by varying the waveforms applied to the ink actuator from the control unit 190.

Figure 3A:
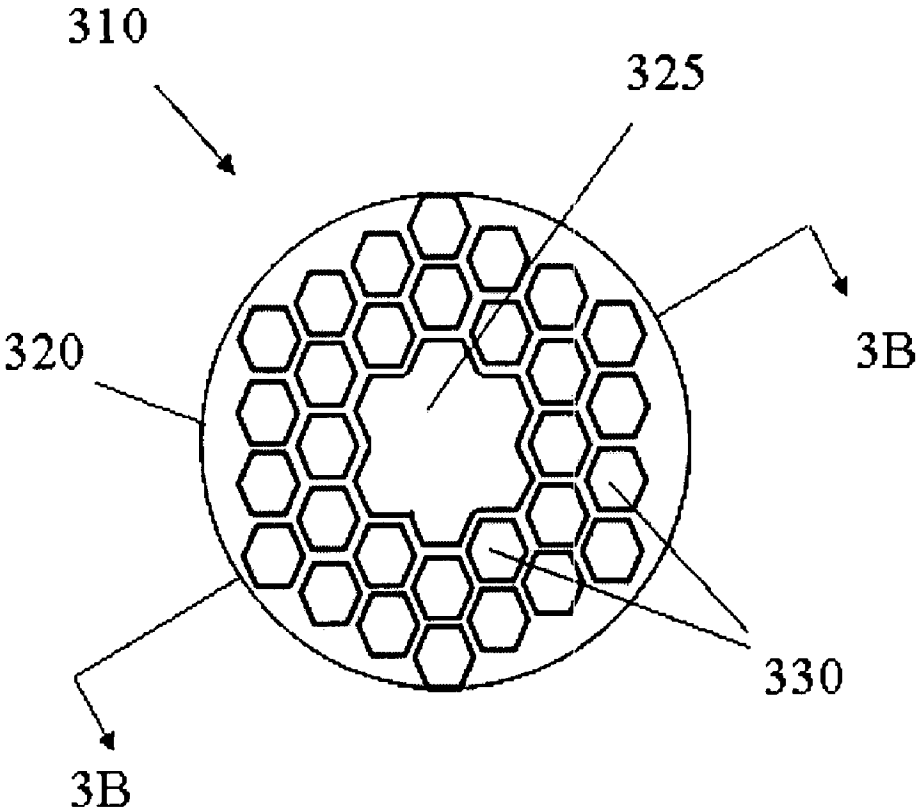
FIG. 3A is a top view of another implementation of an ink nozzle.

In another embodiment, FIG. 3A illustrates a top view of another implementation of an ink nozzle 310 compatible with the ink jet print head module 110. The ink nozzle 310 defines a nozzle region 320 comprising a first orifice 325 in the center and a plurality of second orifices 330 surrounding the first orifice 325. The orifices 325, 330 are disposed in a compact formation within a substantially circular area defined by the nozzle region 320. The orifices 325 and 330 can take the shape of hexagons, triangles, a square, a circle, or a polygon, etc. The orifices 330 can have substantially the same dimensions whereas the orifice 325 has a wider dimension. The nozzle region 220 typically spans in a range of 1 μm to 300 μm. The orifice opening dimensions are typically in the range of 1 μm to 100 μm, preferably in the range of 3 μm to 50 μm.

Figure 3B:
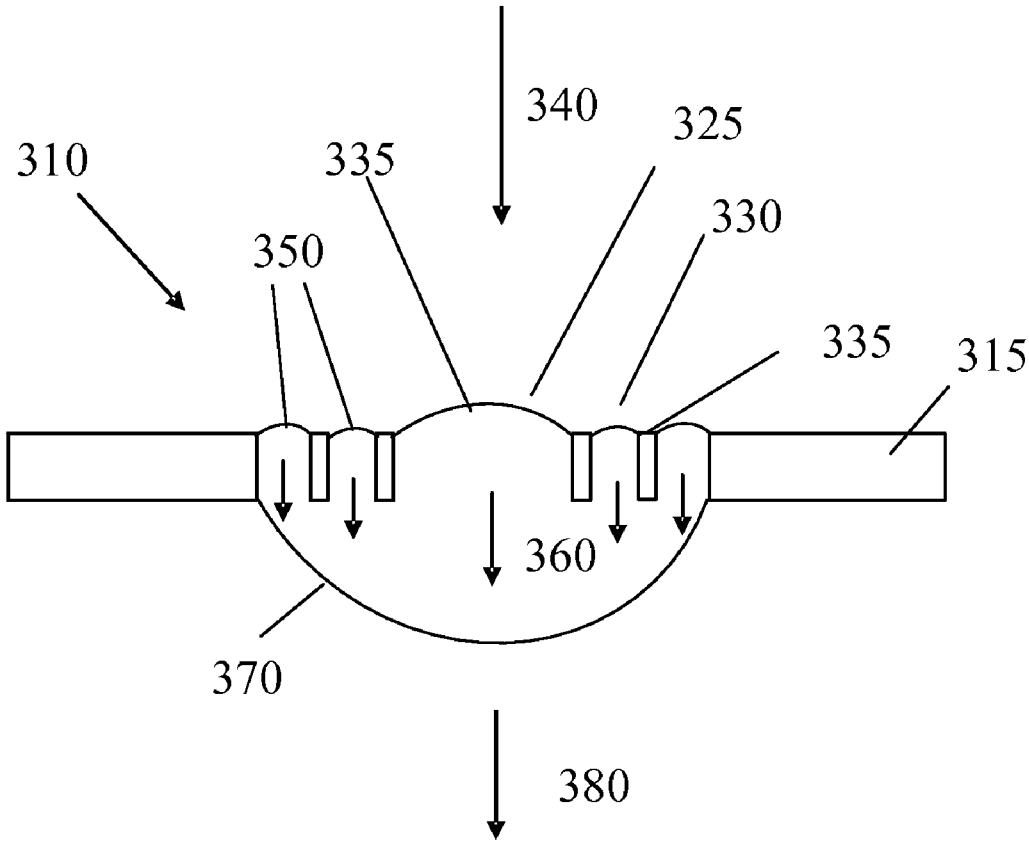
FIG. 3B illustrates a cross-sectional view of the ink nozzle of FIG. 3A.

FIG. 3B illustrates a cross-sectional view of the ink nozzle 310 of FIG. 3A along 3B-3B. The ink nozzle 310 is formed in a nozzle plate 315. The cross section of the ink nozzle 310 includes the orifice 325 and orifices 330 separated by separation walls 335. The ink fluid is supplied from the fluid conduit 130 along the direction 340. In non-ejection states, separate meniscuses 350 and 355 are formed in the orifice 325 and orifices 330. The meniscuses 350 and 355 are in concave shapes curving toward the direction of the fluid conduit 130 as a result of the negative pressure applied to the ink body. The negative ink pressure holds the ink meniscuses 350, 355 at the inner ends of the ink orifices 325, 330 and prevents the ink from spilling over the nozzle plate 315. Before ink ejection, an outward pressure wave is generated in the ink fluid by the ink actuator under the control of the control unit 190. The ink fluid is pushed outward along direction 360. The ejected ink fluid from separate ink orifices 325, 330 merge to form a common ink surface 370 moving along an outward direction 380. An ink drop is then broken off which may finally land on an ink receiver 180.

In one implementation, the ink ejected from different orifices 325 and 330 can first form separate ink drops while emerging before merging into one or more ink drops in flight or on the ink receiver 180. In another implementation, the widths of the separation walls 335 are substantially equal or smaller than the widths of the fluid ejected from the orifices 325 and 330 such that the fluid ejected from the orifices 325 and 330 can be merged into a fluid drop.

The wider orifice 325 serves several functions in comparison to the ink nozzle 210 in which the orifices are substantially equal. First, the orifice 325 produces a larger ejected ink fluid in the center of the nozzle region 320, which better defines the symmetric direction of the merged ink drop. Second, the orifice 325 has a lower bubble pressure than those of orifices 330. The waveform applied to the ink actuator by the control unit 190 can thus be manipulated so that ink is ejected only from the orifice 325 but not from orifices 330. The ability to eject a smaller ink drop is very desirable especially for high-resolution ink printing applications.

The orifices 325 and 330 of different dimensions and the nozzle plate 315 can be formed in a silicon substrate. The orifices are fabricated using one or more of etching, laser ablation, and electroforming. For example, fabrication techniques disclosed in commonly assigned U.S. Pat. No. 5,265,315, U.S. patent application Ser. No. 10/189,947, U.S. Patent Publication No. U.S. 20040004649A1, titled "Printhead", filed on Jul. 3, 2002, and U.S. Provisional Patent Application No. 60/510,459, titled "Print head with thin membrane", filed Oct. 10, 2003. The content of these patent applications and publications are herein incorporated by reference.

Figure 4A:
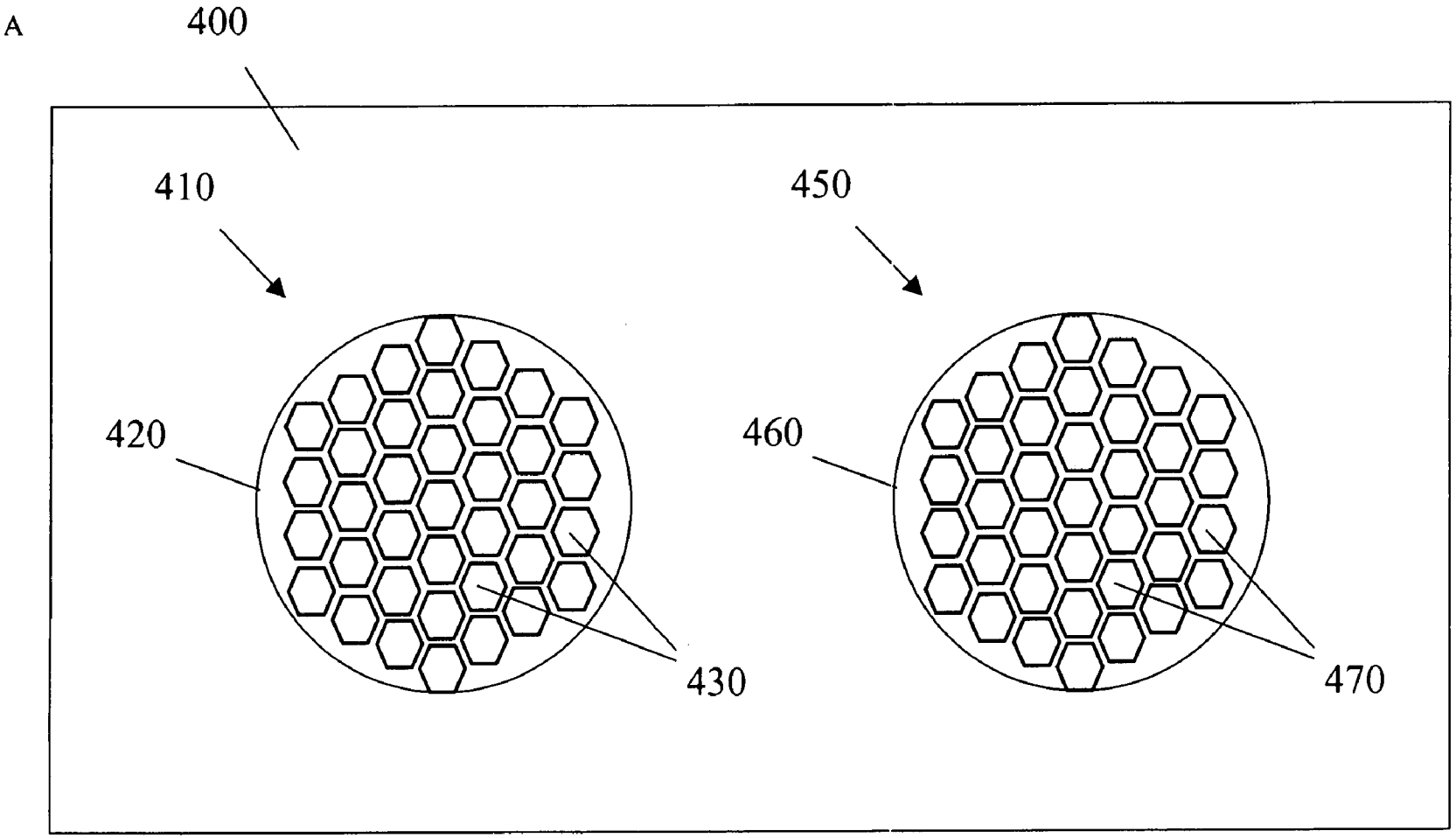
FIG. 4A is a top view of a plurality of ink nozzle with each ink nozzle having a plurality of ink orifices.
Figure 4B:
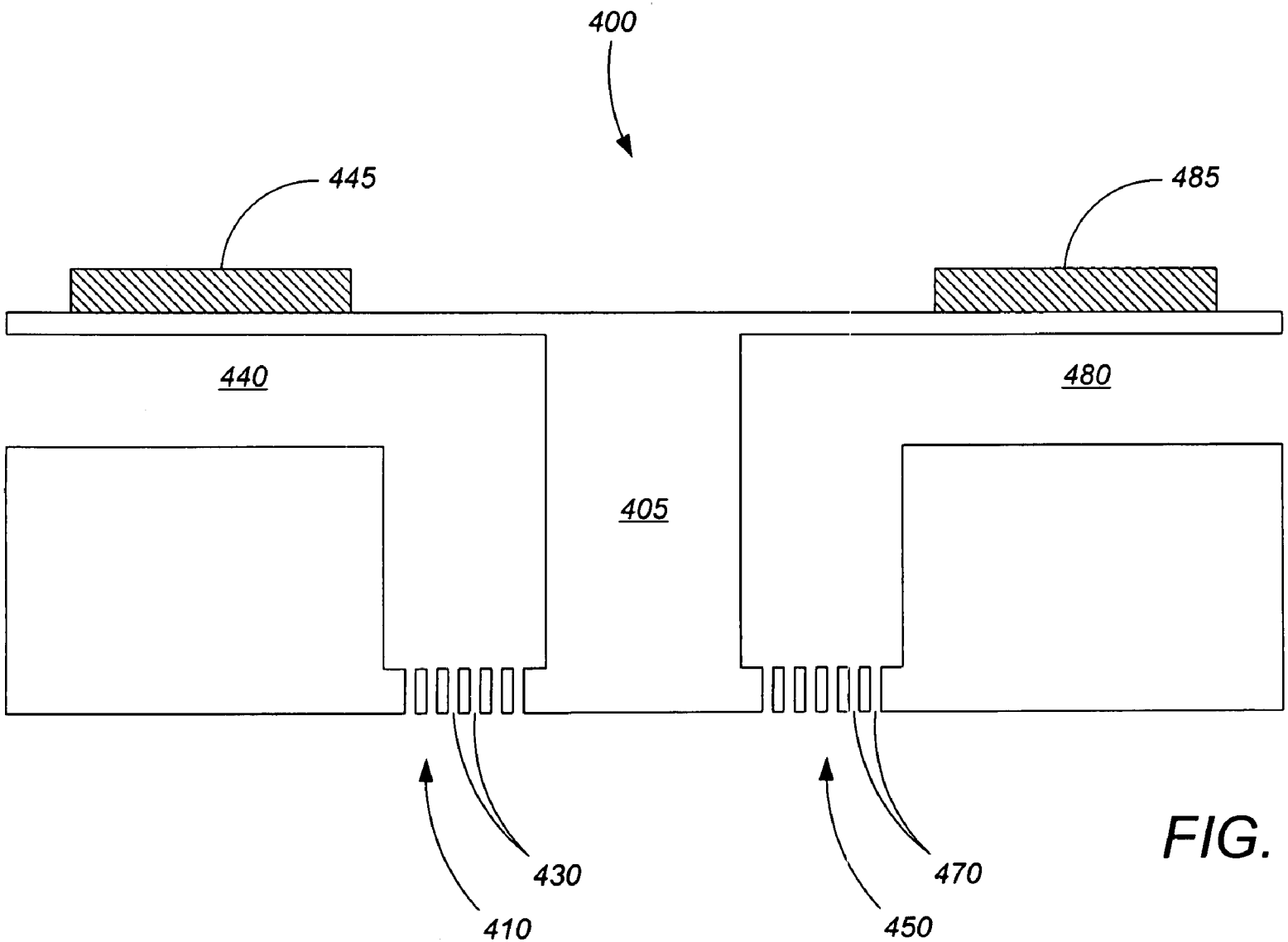
FIG. 4B illustrates a cross-sectional view of the ink nozzles of FIG. 4A

In one implementation, the print head can include a plurality of ink nozzles 410, 450 each comprising groups of orifices 430, 470 on a nozzle plate 400 as shown in FIG. 4A. The ink nozzle 410 includes a group of ink orifices 430 distributed in a nozzle region 420. Similarly, the ink nozzle 450 includes a group of ink orifices 470 disposed in a nozzle region 460. The nozzle regions 420, 460 can be generally circular.

The spacing between adjacent ink nozzles 410, 450 is significantly larger than the distances between neighboring ink orifices 430, 470 within each nozzle group, which enables the merging of ejected ink from different orifices within a nozzle group. In contrast, the ink fluids ejected from different nozzles can merge before they arrive at the ink receiver 180 because the larger distance between adjacent nozzles than the distances between the adjacent orifices within the same nozzle. The ink nozzles 410, 450 can form linear arrays or other patterns for effective depositions of ink drops. The nozzles in linear arrays can be aligned orthogonal or oblique to the fast scan direction of the printhead module 110 relative to the ink receiver 180. Different ink nozzles each comprising groups of orifices can be optimized to be suitable for ejecting ink drops of different volumes.

Fluid conduits 440, 480, formed in a silicon body 405, provide the ink to the nozzles 410, 450, respectively. Each fluid conduit 440, 480 can have its own associated actuator 445, 485, respectively, such that fluid in one of the conduits 440, 480 can be independently ejected from the associated nozzle 410, 450. As illustrated, all of the orifices defining a particular nozzle are fluidly coupled to the same conduit, but each particular nozzle has its own conduit. Alternatively, two or more nozzles from a plurality of nozzles could be fluidly coupled to a common conduit with a common actuator. As yet another alternative, some orifices from the group of orifices that form a nozzle could be connected to a different conduits with separate actuators. In this case, the action of the actuators could be coordinated by the controller to cause the actuators associated with a given nozzle to fire simultaneously so as to cause the ink emerging from the orifices to merge into a fluid drop.

A number of embodiments of the invention have been described. Nevertheless, it will be understood that various modifications may be made without departing from the spirit and scope of the invention. Accordingly, other embodiments are within the scope of the following claims.

What is claimed is:

1. A drop ejection device, comprising:

a group of orifices in a nozzle plate adapted to eject fluid drops, wherein the orifices in the group are arranged in a 2D array where at least some of the orifices are adjacent and have a same size and a maximum distance between each adjacent orifice in the group of orifices is less than any lateral dimension of each of the same sized orifices;

a fluid conduit fluidly coupled to the group of orifices;

an actuator capable of ejecting fluid in the fluid conduit through at least two of the orifices in the group;

a controller coupled to the actuator;

wherein the orifices and controller are configured such that the fluids ejected from the orifices merge into a fluid drop having a particular drop volume on the nozzle plate, and each orifice having a bubble pressure over 6 inch wg, the bubble pressure in each orifice being greater than a bubble pressure of a single nozzle ejecting the same drop volume; and a pressure regulator to apply a negative pressure to the fluid in the fluid conduit, the magnitude of the negative pressure being smaller than the bubble pressure in each orifice.

2. The drop ejection device of claim 1, wherein the orifices in the group of orifices have substantially the same dimensions.

3. The drop ejection device of claim 1, wherein at least two orifices in the group of orifices have different dimensions.

4. The drop ejection device of claim 3, wherein the group of orifices includes a first orifice and a plurality of second orifices, wherein the first orifice is surrounded by the plurality of second orifices.

5. The drop ejection device of claim 4, wherein the opening of the first orifice is wider than the openings of the second orifices.

6. The drop ejection device of claim 1, wherein portions of a body separating the orifices are substantially equal or smaller than the widths of the fluid ejected from the orifices.

7. The drop ejection device of claim 1, wherein the actuator includes a piezoelectric transducer or a heater.

8. The drop ejection device of claim 1, wherein the controller is configured to select one of a plurality of different drive voltage waveforms.

9. The drop ejection device of claim 8, wherein a first of the plurality of different drive voltage waveforms causes fluid to be ejected from a first orifice in the group of orifices and not to be ejected from a second orifice in the group of orifices, and a second of the plurality of different drive voltage waveforms causes fluid to be ejected from the first orifice and the second orifice of the group of orifices.

10. The drop ejection device of claim 1, wherein the orifices are configured such that separate meniscuses are formed at different orifices in the group of orifices.

11. The drop ejection device of claim 1, wherein the orifices are in the shape of one or more of a hexagon or a triangle.

12. The drop ejection device of claim 1, wherein the group of orifices are located in a substantially circular area.

13. A drop ejection device, comprising:

a plurality of groups of orifices in a nozzle plate adapted to eject fluid drops;

a fluid conduit fluidly coupled to each group of orifices;

an actuator associated with each group of orifices, said actuator being capable of ejecting fluid from the fluid conduit through the orifices;

a controller coupled to the actuator, wherein the orifices in each of the groups are arranged in a 2D array, the orifices are closer to other orifices in the same group than to the orifices from a different group, at least some of the orifices are adjacent and have a same size and a maximum distance between each adjacent orifice in the group of orifices is less than any lateral dimension of each of the same sized orifices in the group so that when fluid is ejected from the orifices in a group as directed by the controller, the fluid merges into a fluid drop having a particular drop volume on the nozzle plate, each orifice having a bubble pressure over 6 inch wg, the bubble pressure in each orifice being greater than a bubble pressure of a single nozzle ejecting the same drop volume; and a pressure regulator to apply a negative pressure to the fluid in the fluid conduit, and the magnitude of the negative pressure being smaller than the bubble pressure in each orifice.

14. The drop ejection device of claim 13, wherein the orifices and controller are configured such that the controller causes the actuator to eject fluid from two or more orifices in the same group of orifices.

15. The drop ejection device of claim 13, wherein the orifices within a group of orifices have substantially the same dimensions.

16. The drop ejection device of claim 13, wherein the orifices within a group of orifices have different dimensions.

17. The drop ejection device of claim 16, wherein the orifices within a group include a first orifice and a plurality of second orifices surrounding the first orifice.

18. The drop ejection device of claim 13, wherein the actuator includes a piezoelectric transducer or a heater.

19. The drop ejection device of claim 13, wherein separate meniscuses are formed at different orifices in each group of orifices.

20. The drop ejection device of claim 13, wherein each group of orifices are formed in a substantially compact area on the nozzle plate.

21. The drop ejection device of claim 13, wherein at least one group of orifices is formed in a substantially circular area on the nozzle plate.

22. The drop ejection device of claim 13, wherein the orifices are in the shape of a hexagon or a triangle.

23. The drop ejection device of claim 13, wherein the orifices comprise opening dimensions in the range from 1 μm to 100 μm.

24. The drop ejection device of claim 13, wherein the orifices comprise opening dimensions in the range from 3 μm to 50 μm.

25. The drop ejection device of claim 13, wherein the orifices in a group of nozzles are hexagonal and are in a honeycomb formation.

26. The drop ejection device of claim 13, wherein a group has at least three orifices.

27. An ink jet print head, comprising:

a group of orifices in a nozzle plate adapted to eject ink drops, wherein the orifices in the group are arranged in a 2D array where at least some of the orifices are adjacent and have a same size and a maximum distance between each adjacent orifice in the group of orifices is less than any lateral dimension of each of the same sized orifices;

a fluid conduit fluidly coupled to the group of orifices;

an actuator capable of ejecting an ink fluid in the fluid conduit through at least two of the orifices;

a controller coupled to the actuator;

wherein the orifices and controller are configured such that the ink fluids ejected from the orifices merge into an ink drop having a particular drop volume on the nozzle plate, each orifice having a bubble pressure over 6 inch wg, the bubble pressure in each orifice being greater than a bubble pressure of a single nozzle ejecting the same drop volume; and a pressure regulator to apply a negative pressure to the fluid in the fluid conduit, and the magnitude of the negative pressure being smaller than the bubble pressure in each orifice.

28. An ink jet print head, comprising:

a plurality of groups of orifices in a nozzle plate adapted to eject ink drops;

a fluid conduit fluidly coupled to each group of orifices; and an actuator associated with each group of orifices, said actuator being capable of ejecting an ink fluid from the fluid conduit through the orifices;

a controller coupled to the actuator, wherein the orifices in each of the groups are arranged in a 2D array, the orifices are closer to other orifices in the same group than to the orifices from a different group, at least some of the orifices are adjacent and have a same size and a maximum distance between each adjacent orifice in the group of orifices is less than any lateral dimension of each of the same sized orifices, the controller and the orifices in each group are configured so that fluid ejected from the orifices in a group merge into a fluid drop having a particular drop volume on the nozzle plate, each orifice having a bubble pressure over 6 inch wg, the bubble pressure in each orifice being greater than a bubble pressure of a single nozzle ejecting the same drop volume, and the orifices within a group are disposed in a substantially non-linear pattern; and a pressure regulator to apply a negative pressure to the fluid in the fluid conduit, and the magnitude of the negative pressure being smaller than the bubble pressure in each orifice.

29. A method for ejecting fluid, comprising:

providing a fluid conduit fluidly coupled to a group of orifices, wherein the group of orifices are in a nozzle plate, the orifices in the group are arranged in a 2D array where at least some of the orifices are adjacent and have a same size and a maximum distance between each adjacent orifice in the group of orifices is less than any lateral dimension of each of the same sized orifices;

ejecting a fluid from the conduit fluidly through at least two orifices in the group;

merging the ejected fluid into a fluid drop having a particular drop volume at the nozzle plate, each orifice having a bubble pressure over 6 inch wg, the bubble pressure in each orifice being greater than a bubble pressure of a single nozzle ejecting the same drop volume; and applying a negative pressure to the fluid in the fluid conduit, and the magnitude of the negative pressure being smaller than the bubble pressure in each orifice.

30. The method of claim 29, further comprising forming separate fluid meniscuses in the orifices within the group of orifices.

31. The method of claim 29, further comprising actuating the fluid in the fluid conduit with an actuator.

32. The method of claim 31, further comprising varying the volume of the fluid drop by controlling the actuator.

33. The method of claim 29, further comprising forming a dot on a fluid-receiving substrate.

34. The method of claim 29, wherein the group of orifices includes a first orifice and a plurality of second orifices, and wherein the first orifice is surrounded by the plurality of second orifices.

35. The method of claim 34, wherein the first orifice has a wider opening than the second orifices.

36. The method of claim 29, wherein the group of orifices is disposed in a substantially circular area on the nozzle plate.

37. The method of claim 29, wherein the orifices in the group are distributed in a substantially non-linear pattern on the nozzle plate.

38. A method for forming an ink ejection system, comprising:

forming a plurality of groups of orifices in a nozzle plate, the orifices adapted to eject fluid drops, wherein the orifices in each of the groups are arranged in a 2D array and are closer to other orifices in the same group than to the orifices from a different group, at least some of the orifices are adjacent and have a same size, a maximum distance between each adjacent orifice in a group of orifices is less than any lateral dimension of each of the same sized orifices and the orifices are configured so that fluid ejected from the orifices in a group of orifices merge into a fluid drop having a particular drop volume on the nozzle plate, each orifice having a bubble pressure over 6 inch wg, the bubble pressure in each orifice being greater than a bubble pressure of a single nozzle ejecting the same drop volume;

coupling a plurality of fluid conduits to the plurality of groups of orifices and applying a negative pressure to the fluid in the plurality of fluid conduits, and the magnitude of the negative pressure being smaller than the bubble pressure in each orifice.

39. The method of claim 38, further comprising forming a plurality of actuators associated with the plurality of fluid conduits to eject fluid from the plurality of groups of orifices.

40. The method of claim 39, further comprising connecting a controller to the plurality of actuators.

41. The method of claim 40, further comprising configuring the controller such that the controller causes the actuator to eject fluid from the two or more orifices in the same group.

42. The method of claim 38, wherein the orifices are formed such that separate meniscuses are formed at the different orifices in the same group of orifices.

43. The method of claim 38, wherein forming a plurality of groups of orifices includes forming a first orifice and one or more second orifices, wherein the first orifice has a wider opening than the second orifices.

44. The method of claim 38, further comprising forming an orifice substantially in the shape of a hexagon, a triangle, or square.

45. The method of claim 38, wherein forming a plurality of groups of orifices includes disposing a group of orifices in a substantially circular area on the nozzle plate.

46. The method of claim 38, wherein forming a plurality of groups of orifices includes forming orifices having opening dimensions in the range of 1 μm to 100 μm.

47. The method of claim 38, further comprising fabricating the plurality of fluid conduits in a silicon substrate.

48. The method of claim 38, wherein forming a plurality of groups of orifices includes fabricating orifices using one or more of etching, laser ablating, or electroforming.

* * * * *

UNITED STATES PATENT AND TRADEMARK OFFICE

CERTIFICATE OF CORRECTION

PATENT NO. : 7,484,836 B2
APPLICATION NO. : 10/946355
DATED : February 3, 2009
INVENTOR(S) : Edward R. Moynihan It is certified that error appears in the above-identified patent and that said Letters Patent is hereby corrected as shown below:

Column 12, Line 52, Claim 38, replace:

"groups of orifices" with
-- groups of orifices; --

Column 13, Line 7, Claim 44, replace:

"square" with
-- a square --

Signed and Sealed this

Seventh Day of April, 2009

JOHN DOLL
*Acting Director of the United States Patent and Trademark Office*